US006703771B2

(12) United States Patent
Becker et al.

(10) Patent No.: US 6,703,771 B2
(45) Date of Patent: Mar. 9, 2004

(54) MONOCHROMATIC VACUUM ULTRAVIOLET LIGHT SOURCE FOR PHOTOLITHOGRAPHY APPLICATIONS BASED ON A HIGH-PRESSURE MICROHOLLOW CATHODE DISCHARGE

(75) Inventors: Kurt F. Becker, New York, NY (US); Peter F. Kurunczi, Jamaica, NY (US); Karl H. Schoenbach, Norfolk, VA (US)

(73) Assignee: Trustees of Stevens Institute of Technology, Hoboken, NJ (US)

( * ) Notice: Subject to any disclaimer, the term of this patent is extended or adjusted under 35 U.S.C. 154(b) by 58 days.

(21) Appl. No.: 09/876,238

(22) Filed: Jun. 7, 2001

(65) Prior Publication Data

US 2003/0178928 A1 Sep. 25, 2003

Related U.S. Application Data

(60) Provisional application No. 60/210,212, filed on Jun. 8, 2000.

(51) Int. Cl.[7] ..... H01J 1/88

(52) U.S. Cl. ..... 313/250; 313/572; 313/574; 313/618; 313/637; 313/640; 313/641; 313/642

(58) Field of Search ..... 313/250, 572, 313/574, 618, 637, 640, 641, 642, 631

(56) References Cited

U.S. PATENT DOCUMENTS

| | | | | | |
|---|---|---|---|---|---|
| 4,340,840 | A | * | 7/1982 | Aboelfotoh et al. | 315/58 |
| 5,079,473 | A | * | 1/1992 | Waymouth | 313/112 |
| 5,331,249 | A | * | 7/1994 | Minamikata et al. | 313/632 |
| 6,052,401 | A | * | 4/2000 | Wieser et al. | 372/74 |
| 6,072,273 | A | * | 6/2000 | Schoenbach et al. | 313/491 |
| 6,194,833 | B1 | * | 2/2001 | DeTemple et al. | 313/631 |
| 6,323,594 | B1 | * | 11/2001 | Janning | 313/495 |
| 6,346,770 | B1 | * | 2/2002 | Schoenbach et al. | 313/491 |

* cited by examiner

*Primary Examiner*—Nimeshkumar D. Patel
*Assistant Examiner*—Holly Harper
(74) *Attorney, Agent, or Firm*—Licata & Tyrrell P.C.

(57) ABSTRACT

A light source with a sealed, light-transmissive tube filled with high pressure gases or high pressure gas mixtures and a microhollow cathode (MHC) discharge capable of excimer production are provided.

2 Claims, 5 Drawing Sheets

MONOCHROMATIC VACUUM ULTRAVIOLET LIGHT SOURCE FOR PHOTOLITHOGRAPHY APPLICATIONS BASED ON A HIGH-PRESSURE MICROHOLLOW CATHODE DISCHARGE

INTRODUCTION

This application claims the benefit of priority of U.S. Provisional Application Serial No. 60/210,212 filed Jun. 8, 2000.

This work was supported by the United States National Science Foundation (NSF) under awards PHY-9722438 and PHY-9986692, ECS-98033997, and CTS-0078618; and by the U.S. Defense Advanced Research Projects Agency (DARPA) under contract DAAD19-99-1-0277. The U.S. Government has certain rights in this invention.

FIELD OF THE INVENTION

This invention relates to gas discharge devices which utilize a cathode and dielectric spacer having a single hole or an array of holes therein and an arbitrarily shaped anode, and methods of use thereof.

BACKGROUND OF THE INVENTION

Optical lithography is used e.g. by the semiconductor industry to generate the small features which determine the size of the electronic circuits on semiconductor wafers. Mercury arc lamps have been used as light sources for such photolithography.

In order to reduce chip feature sizes excimer laser have been used such as the 248 nm KrF laser. Excimer lasers used for deep-UV photolithography are discharge pumped. Efficiencies are on the order of one percent to two percent. They only exist as pulsed devices with pulse duration of tens of $\mu$s determined by the plasma stability. Voltages required to operate them are in the multi-kV range.

Non-coherent excimer radiation and other sources of monochromatic vacuum ultraviolet (VUV) light are also being explored. Excimers are temporary chemical compounds composed of atoms which under normal conditions would not form a stable molecule. A stable excimer molecule is only formed in a high-energy, or excited, state. The excimer molecule as a whole decays into the constituent atoms upon emission of characteristic radiation. Excimers have been produced e.g. by applying beams of energized particles to inert gases. The gas is present under substantial pressure. Another means of producing excimers are high-pressure discharge plasmas such as e.g. plasmas produced in microhollow (MHC) cathode discharges.

The present invention provides a method and apparatus for the production of intense hydrogen Lyman-a as well as Lyman-β emissions and other atomic emissions from a microhollow cathode (MHC) discharge operated in a mixture of high-pressure Neon (Ne), Helium (He), or Argon (Ar) with a small admixture of Hydrogen ($H_2$), Nitrogen ($N_2$, or Oxygen ($O_2$).

SUMMARY OF THE INVENTION

An object of the present invention is to provide a light source comprising a sealed, light-transmissive tube containing high pressure gases or high pressure gas mixtures at a high pressure (100 Torr to 10,000 Torr) with a discharge device consisting of a first conducting electrode (cathode) having a single hole or a plurality of holes therein and a second conducting electrode (anode, which may or may not have a hole or holes similar to the one(s) in said first electrode), mounted within said tube and separated from first electrode by an insulating spacer with a hole or holes therein similar to hole(s) in said first electrode; and electrical means for coupling electrical energy to said first and second electrodes for producing discharges in each of the holes in said first electrode. The exact shape of the hole(s) in said first electrode and the insulating spacer are not important as long as the area of the hole(s) is in the range from 0.001 $mm^2$ and 1 $mm^2$ (microhollow cathode (MHC) discharge).

Another object of the present invention is to provide a method of generating intense hydrogen Lyman-a or Lyman-β or atomic oxygen and nitrogen emissions in the spectral range from 100 nm to 150 nm by placing the MHC discharge device into a container which contains a high pressure gas or high pressure gas mixture.

Another object of the present invention is to provide a method of generating an extended source of higher irradiance over an extended area by using an array of MHC discharge sources operated in parallel.

DETAILED DESCRIPTION

Figure 1:
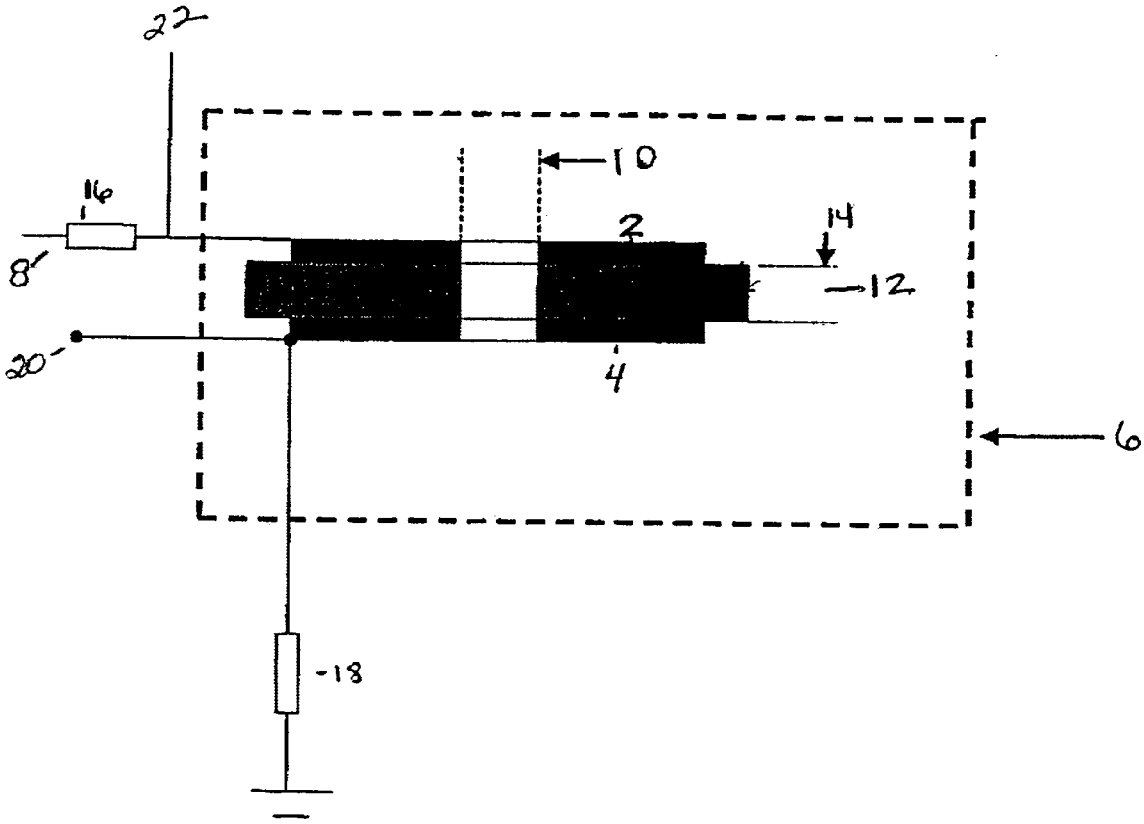
FIG. 1 shows an MHC discharge device.

MHC discharges are conceptually simple, efficient sources of excimer radiation. Excimer emissions are based on the formation of excited molecular dimer complexes, known as excimers, in, for example, the rare gases. Excimer molecules are formed via three-body collisions involving a metastable rare gas atom and two ground state atoms and via other collisional interactions between electrons and atomic and molecular ions. The conditions for efficient excimer formation require a sufficiently large number of electrons with energies above the threshold for the formation of metastable rare gas atoms. Rare gas excimer emission spectra are dominated by the second excimer emission continua of the pure rare gas molecules which are emitted in a transition from the lowest-lying excited bound excimer state to the repulsive ground state. The peaks in the second continua of the rare gases are at wavelengths of 170 nm (Xe), 145 nm (Kr), 128 nm (Ar) and 84 nm (Ne), respectively. The first excimer continua of the pure rare gases can be observed as a shoulder on the short wavelength side of the second continua.

In one embodiment, the present invention provides a light source comprised of a sealed, light-transmissive tube containing a gas or a gas mixture at high pressures ranging from 100 Torr to 1500 Torr; a first electrode (cathode) having a single hole or a plurality of holes therein mounted within the light-transmissive tube and a second electrode (anode, which may or may not have a hole or holes similar to the hole(s) in said first electrode) mounted within said tube and separated from the cathode by an insulating spacer with a hole or holes similar to the hole(s) in said first electrode. The exact shape of the holes in said first electrode and the insulating spacer are not important as long as the area of the holes is in the range from 0.001 $mm^2$ and 1 $mm^2$. Means are provided for coupling electrical energy to said first and second electrodes for producing MHC discharges in each of the holes in said first electrode. Both electrodes, i.e. the anode and the cathode have a thickness of from about 0.05 mm to about 0.5 mm. The insulating spacer has a thickness of from about 0.1 mm to 1 mm. The gas or gas mixture is present in the device at high pressure in the range of about 100 Torr to about 10,000 Torr. The gas may be stagnant or flowing through the electrodes of the MHC discharge device.

In a preferred embodiment the high pressure gas is Ne, He, or Ar. The high pressure gas may be a single gas or a mixture of two or more gases, i.e. a primary gas and secondary gas(es). In a preferred embodiment the secondary gases which form a mixture with the primary gases may be selected from $H_2$, $N_2$, or $O_2$. In an especially preferred embodiment the high pressure gas is a mixture of Ne and $H_2$, Ne and $N_2$, Ar and $O_2$, He and $N_2$, or He and $O_2$.

The term "primary gas" is meant to refer to the gas which constitutes the majority of the high pressure gas mixture, when the high pressure gas is composed of a mixture of gases, or of a sole gas. The term "secondary gas" is meant to refer to a gas or gases present as a minority percentage of the total gas mixture when the high pressure gas is present as a mixture of gases. Two or more secondary gases may combine with a primary gas to form the high pressure gas mixture. Preferably, the amount of secondary gas, i.e., $N_2$, $H_2$ and $O_2$ is less than 1% of the total gas pressure in the light source.

FIG. 1 depicts a MHC discharge device. The discharge device includes a cathode 2 and an anode 4 mounted within a discharge chamber 6. The discharge chamber 6 is typically sealed and contains a high pressure gas or high pressure gas mixture at a prescribed pressure, P. A power source supplies energy to the discharge device. Supply voltages($V_o$) 8 typically 300–1000 V are provided by a direct current power supply. Other modes of electrical power supply can be used such as an alternating current power supply with frequencies ranging from 100 Hz to 500 kHz or a radio frequency power supply with frequencies in the range from 1 MHz to 50 MHz, or pulse generators providing electrical pulses of $10^{-8}$ s to 0.1 s in duration.

A MHC discharge consists of a cathode with a single hole or a plurality of holes with hole diameters, D, 10 of about 30–1,000 $\mu$m separated from the anode by a thin sheet of dielectric spacer 12. The hole or holes are formed in the surface of the cathode and in the insulating spacer and they may or may not be formed in the anode. The exact shape of the hole(s) in said first electrode and the insulating spacer are not important as long as the area of the hole(s) is in the range from 0.001 $mm^2$ and 1 $mm^2$ (microhollow cathode (MHC) discharge). Discharges in such geometry show several modes of operation as a function of gas pressure (P), hole diameter (D) 10, cathode-anode separation (d) 14 and discharge current (I). $V_{dis}$, $R_c$, V, $R_{CVR}$ and Ground are components of the electric circuit. V 20 is the externally applied voltage, $V_{dis}$ 22 refers to the discharge sustaining voltage, and $R_C$ 16 and $R_{CVR}$ 18 are appropriately chosen resistors that allow the proper operation of the MHC discharge and allow us to monitor the discharge properties. The exact shape of the hole(s) in said first electrode and the insulating spacer are not important as long as the area of the hole(s) is in the range from 0.001 $mm^2$ and 1 $mm^2$.

The conditions in an MHC discharge satisfy the two criteria necessary for excimer formation, i.e., the MHC discharges have a sufficiently large number of electrons with energies larger than the ionization/excitation energy of the noble gas atoms; and the MHC discharges can be operated at pressures that are high enough so that the three-body collisions required for excimer formation occur with sufficient frequency. The electrode geometry for a single hole MHC excimer lamp, as depicted in FIG. 1, consists of two metal plates with an opening, separated by dielectric spacer. Alternatively, the anode may consist of an electrode without holes.

In one embodiment, both cathode and anode consist of molybdenum. The electrodes are separated by a dielectric spacer. In a preferred embodiment, the dielectric spacer is alumina ($AL_2O_3$) or mica which withstand high temperatures. The hole may have diameters from 30 $\mu$m to 1000 $\mu$m. The electrodes may be of any material which is conductive. The dielectric spacer between the electrodes may be of any insulator material. The electrodes may be on the order of about 30–250 $\mu$m thick and the dielectric spacer between them may be on the order of about 100–500 $\mu$m thick. The exact shape of the hole(s) in said first electrode and the insulating spacer are not important as long as the area of the hole(s) is in the range of from about 0.001 $mm^2$ to about 1 $mm^2$.

Typical discharge sustaining voltages are 150–300 V, with currents ranging from 0.1 mA to 20 mA (dc equivalent).

The electrodes are placed in a sealed vessel filled with high pressure gas or high pressure gas mixture at a high pressure. The gas filled vessel, which allows optical access, preferably, from the front and back of the vessel. Electrical connections supply power to the electrodes, and gas inlets and outlets which allow evacuation of the vessel and filling with the desired gas mixture. This design also permits flow of the gas through the hole in the discharge device. Preferably, the window is $MgF_2$ or LiF which are transparent for deep UV light.

Figure 2:
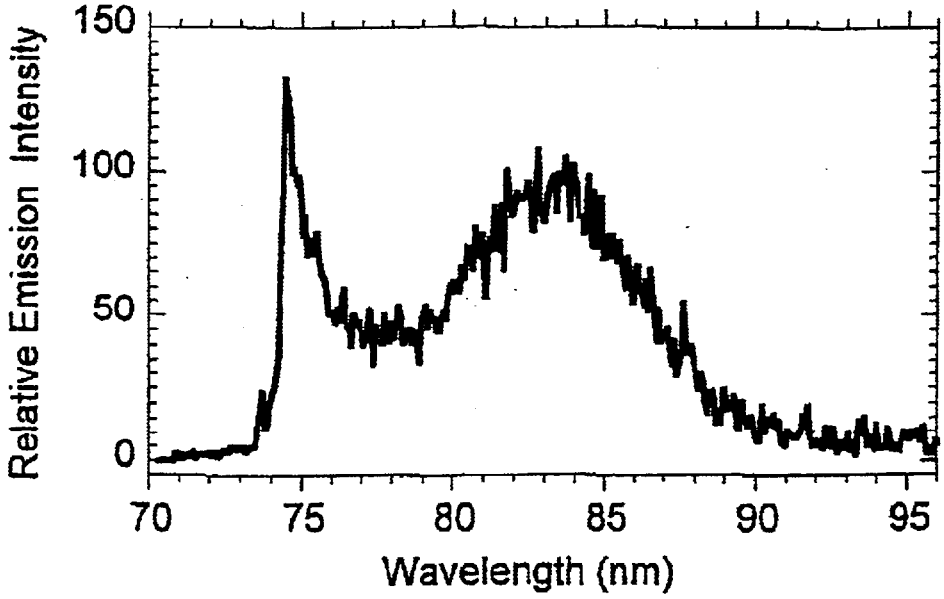
FIG. 2 shows emission spectrum from a MHC discharge operated in high-pressure with pure Ne gas.

FIG. 2 depicts the emission spectrum from an MHC discharge in pure Ne at 740 Torr in the wavelength region 70–100 nm recorded with a full width at half maximum (FWHM) spectral resolution of 0.25 nm. The spectrum has two characteristic features, i.e., a sharp asymmetric peak in the 73–78 nm region with maximum intensity near 74.5 nm; and a broad continuum from 80 to 88 nm. The first peak in the 73–78 nm region contains the two Ne resonance lines at 73.5 and 74.3 nm respectively, as well as emissions from the $Ne_2^+$ first excimer continuum, whereas the broad continuum in the 80–88 nm region is due to the $Ne_2^+$ second excimer continuum.

Figure 3A:
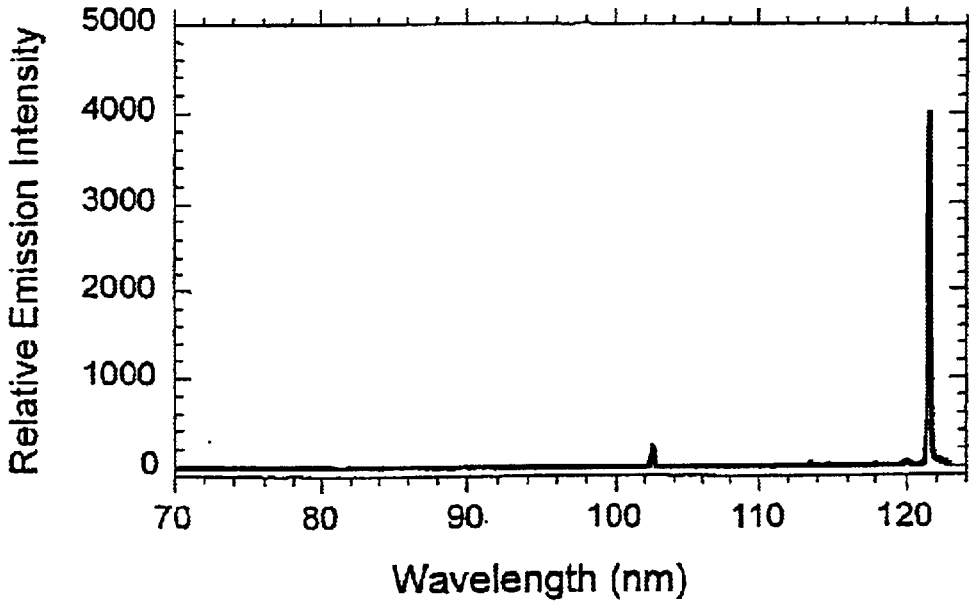
FIGS. 3*a* and 3*b* show emission spectra from a MHC discharge operated in high pressure with a $Ne/H_2$ gas mixture.
Figure 3B:
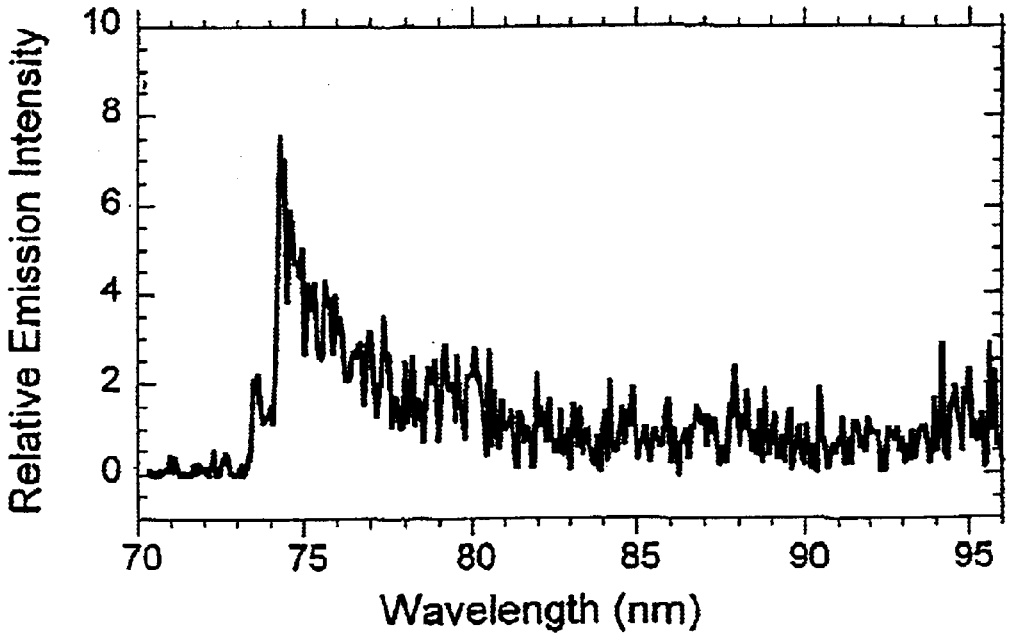

Another embodiment of the present invention provides a method of generating intense hydrogen Lyman-α a or Lyman-β emissions or atomic oxygen and nitrogen emissions in the spectral range from 100 nm to 150 nm by placing the MHC discharge device into a sealed container which contains a high pressure gas or high pressure gas mixture. The high pressure gas mixture may be stagnant or may be flowed through the hole(s) in the MHC discharge device. FIG. 3 shows emission spectra from a MHC discharge operated in high-pressure Ne with a small admixture of $H_2$ at 0.5 Torr. Two figures are shown, a scan covering the entire wavelength range from 70 to 125 nm (a) and a scan covering the wavelength range of the Ne resonance lines and the $Ne_2^+$ second excimer continuum using an expanded intensity scale (b). The most striking observations from FIG. 3(*a*) are the very weak intensity observed in the range of the Ne and $Ne_2^+$ emission and the dominance of the hydrogen Lyman-α line at 121.6 nm. There is also a distinct Lyman-β emission line at 102.5 nm. The expanded intensity scale in FIG. 3 (*b*)

shows that all Ne/$Ne_2$' emission features have been reduced considerably, particularly the second continuum. The emission of the hydrogen Lyman-α emission is due to a near-resonant energy transfer between the $Ne_2^{++}$ and the $H_2$ molecules causing the break-up of the $H_2$ molecule into two H atoms and the simultaneous excitation of one H atom to the n=2 excited state followed by the emission of the H Lyman-α a line at 121.6 nm when the excited H(n=2)atom decays to the n=1 ground state.

The presence of a relatively intense hydrogen Lyman-β line in the spectrum shown in FIG. 3(*a*) cannot be explained by the same process since the maximum energy contained in the $Ne_2^+$ excimer responsible for the emission of the second continuum (15.5 eV) is below the minimum energy required for H(n=3) formation (16 eV). A near resonant energy transfer process involving excited, and likely metastable, Ne atoms and/or vibrationally excited $Ne_2^+$ excimers are responsible for the emission of the H Lyman-β emission.

Figure 4:
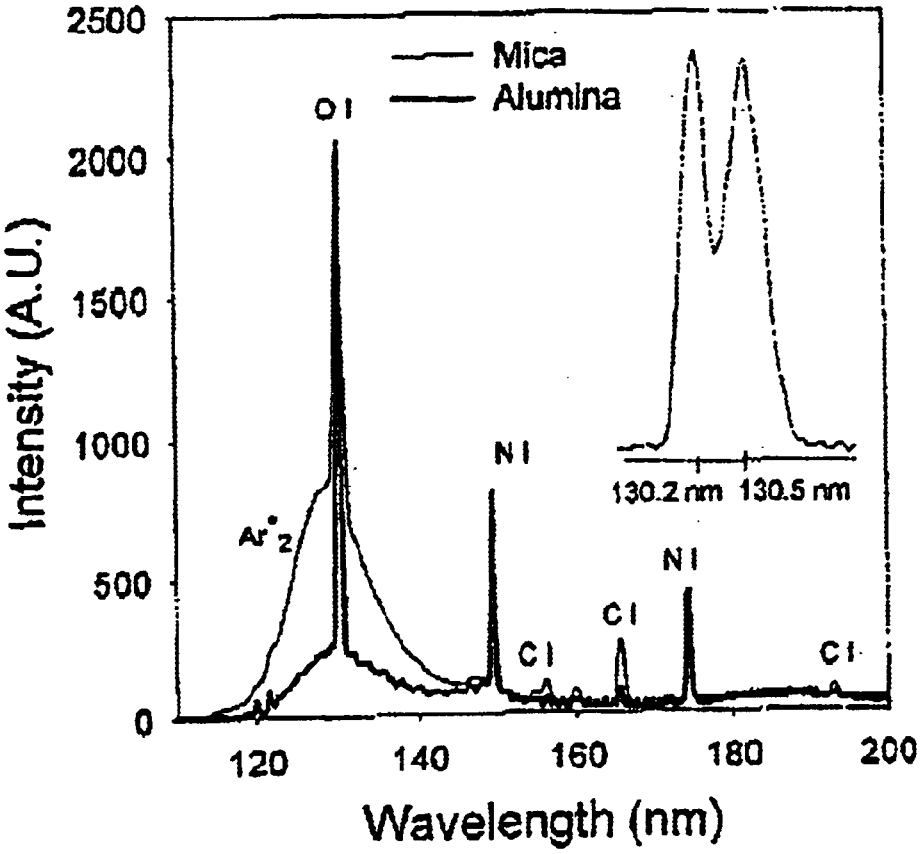
FIG. 4 shows the emission spectrum from a MHC discharge operated in high pressure with an $Ar/O_2$ gas mixture.

FIG. 4 shows the emission spectrum from a MHC discharge operated in high pressure with an $Ar/O_2$ gas mixture. There is a sharp peak in the 120–140 nm range, and particularly at 130.2–130.5 nm.

In another aspect, MHC discharges provide extended sources, rather than a point source, with irradiance covering an extended area. This is achieved by parallel operation of the MHC discharges.

In another aspect, the present invention provides large array extension using a distributed, resistive ballast. This is achieved by using a semi-insulating material as anode material. In producing distributed operation, the light source is made up of a sealed, light-transmissive tube containing gases or gas mixtures at a high pressure, an array of microhollow cathode discharges configured with a plurality of cathodes and a distributed anode, electrical means for coupling electrical energy to the electrodes, and an insulating spacer. The array of microhollow cathode discharges is made of multiple microhollow cathode discharges, wherein each microhollow cathode discharge has a first electrode (or cathode) mounted within said light-transmissive tube. The first electrode has a conductor with a single hole or a plurality of holes therein. Each of said holes in the conductor has an arbitrary shape and an area ranging from 0.001 $mm^2$ to 1 $mm^2$. The anode is made of a distributed resistive ballast comprising a semi-insulating material mounted within the light-transmissive tube and spaced apart from the adjoining first electrode of the microhollow cathode discharge array by an insulator which has a hole or holes similar to the hole(s) in the first electrode. Electrical means are used for coupling electrical energy to said first electrodes and anode for producing discharges in each of the holes in said first electrode. Both the first electrodes of the microhollow cathode discharge arrays and the anode have thicknesses which may range from 0.05 mm to 0.5 mm. The insulating spacer may have a thickness ranging from 0.1 mm to 1 mm. A preferred semi-insulating material is silicon. This distributed array light source allows generation of arrays of MHC discharge excimer sources of any size, limited only by the thermal loading of the ballast resistor. In order to cool the high pressure gas, and to keep it clean, the array may be operated with gas flow by fabricating holes in the semi-insulating layer and anode conductor.

What is claimed:

1. A light source comprising;

a sealed, light-transmissive tube containing gases or gas mixtures at a high pressure;

an array of microhollow cathode discharges comprising multiple microhollow cathode discharges, wherein each microhollow cathode discharge comprises a first electrode mounted within said light-transmissive tube, said first electrode consisting of a conductor having a single hole or a plurality of holes therein, each of said holes having an arbitrary shape and an area in the range from 0.001 $mm^2$ to 1 $mm^2$;

an anode comprising a distributed resistive ballast comprising a semi-insulating material mounted within said light-transmissive tube and spaced apart from the adjoining first electrode of the microhollow cathode discharge array by an insulator which has a hole or holes similar to the hole(s) in the first electrode; and electrical means for coupling electrical energy to said first and second electrodes for producing discharges in each of the holes in said first electrode; and an insulating spacer.

2. The light source of claim 1 wherein the semi-insulating material is silicon.

* * * * *